US009267229B2

(12) United States Patent
Oh et al.

(10) Patent No.: US 9,267,229 B2
(45) Date of Patent: Feb. 23, 2016

(54) DRYER AND METHOD FOR CONTROLLING THE SAME

(75) Inventors: Soo Young Oh, Seoul (KR); Si Moon Jeon, Seoul (KR); Kyung Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 11/727,896

(22) Filed: Mar. 28, 2007

(65) Prior Publication Data

US 2007/0227030 A1 Oct. 4, 2007

(30) Foreign Application Priority Data

Mar. 31, 2006 (KR) ..... 10-2006-0029620

(51) Int. Cl.
*D06F 58/28* (2006.01)
*D06F 58/20* (2006.01)
*D06F 25/00* (2006.01)

(52) U.S. Cl.
CPC ..... *D06F 58/203* (2013.01); *D06F 25/00* (2013.01); *D06F 58/28* (2013.01)

(58) Field of Classification Search
CPC ..... D06F 58/203; D06F 58/28; F26B 3/00; F26B 26/00
USPC ..... 34/404, 409, 411, 415, 443, 516
See application file for complete search history.

(56) References Cited

U.S. PATENT DOCUMENTS

| | | | | | |
|---|---|---|---|---|---|
| 1,991,471 | A * | 2/1935 | Snow et al. | 15/317 |
| 2,621,504 | A * | 12/1952 | Spooner | 68/5 D |
| 4,385,452 | A * | 5/1983 | Deschaaf et al. | 34/562 |
| 4,519,145 | A | 5/1985 | Mandel | |
| 5,214,310 | A * | 5/1993 | Adams | 307/141 |
| 7,325,330 | B2 * | 2/2008 | Kim et al. | 34/407 |
| 2005/0034250 | A1 * | 2/2005 | Oh et al. | 8/159 |
| 2005/0092035 | A1 * | 5/2005 | Shin et al. | 68/275 |
| 2006/0005581 | A1 | 1/2006 | Banba | |
| 2006/0016020 | A1 | 1/2006 | Park | |
| 2006/0112585 | A1 | 6/2006 | Choi | |
| 2006/0277690 | A1 * | 12/2006 | Pyo et al. | 8/149.2 |

FOREIGN PATENT DOCUMENTS

| | | | |
|---|---|---|---|
| CN | 1194131 | | 3/2005 |
| CN | 1696384 | A | 11/2005 |
| EP | 0816550 | A1 | 1/1998 |
| EP | 1657342 | A1 | 5/2006 |
| JP | 06233898 | A | 8/1994 |
| KR | 1020040015957 | * | 2/2004 |
| WO | WO 2004/044302 | A1 | 5/2004 |

OTHER PUBLICATIONS

Machine translation of KR1020040015957.*

* cited by examiner

*Primary Examiner* — Jiping Lu
(74) *Attorney, Agent, or Firm* — Dentons US LLP

(57) ABSTRACT

A dryer is configured to remove static electricity during a drying process. The dryer includes a drum rotatable within a cabinet. The drum is configured to receive laundry. A steam generator generates and exhausts steam into the drum. A steam diffuser uniformly diffuses the steam within the drum. A ventilation system ventilates air within the drum.

10 Claims, 4 Drawing Sheets

DRYER AND METHOD FOR CONTROLLING THE SAME

This application claims the benefit of the Korean Patent Application No. 10-2006-0029620, filed on Mar. 31, 2006, which is hereby incorporated by reference as if fully set forth herein.

BACKGROUND OF THE DISCLOSURE

1. Field of the Disclosure

The present disclosure relates to a dyer, and particularly to a dryer with a steam generator that is configured to remove static electricity and a method for controlling the same.

2. Discussion of the Related Art

In general, dryers are home appliances that are widely used to dry laundry. Recently, dryers with additional functions have been under development.

FIG. 1 schematically illustrates a conventional dryer. The conventional dryer includes a cabinet 10, a drying drum 20, a heater 34, a blower 32 and a motor (not shown). The cabinet 10 defines an exterior housing of the conventional dryer. The drum 20 has a cylindrical shape. The drum 20 is mounted within the cabinet 10 to introduce laundry therein. The heater 34 heats air and the blower 32 ventilates the heated air into the drum 20. The motor (not shown) rotates the drum 20.

An opening 22, formed in a front surface of the cabinet 10, communicates with an inside of the drum 20. A door 40 is coupled to the front surface of the cabinet 10 to open and close the opening 22.

During a drying process, the drum 20 rotates in a clockwise/counter-clockwise direction and air heated by the heater 34 is supplied to the drum 20 by the blower 32 to dry the laundry inside the drum 20.

However, during the drying cycle, static electricity may be generated on the dried laundry by friction between the laundry and drum 20. Thus, a user may experience discomfort or an unpleasant feeling when he/she wears a piece of dried laundry.

SUMMARY OF THE DISCLOSURE

Accordingly, one object is to provide a dryer capable of removing static electricity and a method for controlling the same.

Additional advantages, objects, and features of the disclosure will be set forth in part in the description which follows and in part will become apparent to those having ordinary skill in the art upon examination of the following or may be learned from practice of the invention. The objectives and other advantages of the present invention may be realized and attained by the structure particularly pointed out in the written description and in the claims, as well as the appended drawings.

To achieve these objects and other advantages and in accordance with the purpose of the invention, as embodied and broadly described herein, a dryer includes a drum rotatable within a cabinet, wherein laundry is introduced into the drum; a steam generator that generates and exhausts steam into the drum; a steam diffuser that uniformly diffuses the steam within the drum; and a ventilation system that ventilates air within the drum.

In one aspect, the steam generator includes a water reservoir that holds water; a heater that heats water within the water reservoir to generate steam; and a steam supply tube that guides the steam into the drum.

In another aspect, the steam diffuser includes a fan that diffuses the steam within the drum uniformly.

The fan may finely disperse the steam to allow the steam to diffuse within the drum.

In another aspect, the ventilation system includes a drying heater switchable on/off that heats air to generate dry air; and a blower that allows the air passing the drying heater to flow into the drum.

In another aspect, the ventilation system includes a drying duct through which air outside the drum heated by the drying heater is guided to the drum; and an exhaustion duct through which air inside the drum is exhausted outside.

In another aspect, the ventilation system includes a drying duct through which the air heated by the drying heater is guided to the drum; and a condensation duct through which moisture of the air drawn from the drum is condensed and the air is guided to the drying duct.

In another aspect, a method for a dryer comprises: removing static electricity of laundry within a drum and smoothing out wrinkles of laundry; removing moisture of the laundry within the drum; and cooling the laundry.

In another aspect, the step of removing static electricity of laundry in a drum and smoothing out wrinkles includes steps of operating a drum; exhausting steam into the drum; and diffusing the steam within the drum uniformly.

In another aspect, the heater of a steam generator is switched on and steam is generated in the step of exhausting steam into the drum.

The amount of steam exhausted in the step of exhausting steam into the drum may be adjustable based on the amount of laundry inside the drum.

The amount of the steam may be adjustable based on the heat radiation time of a heater.

In another aspect, the drying heater and a blower of a ventilation system are operated and dry air is ventilated into the drum to dry the laundry, in the step of removing moisture of the laundry within the drum.

In another aspect, the drying heater of a ventilation system is not operated and a blower of a ventilation system is operated to allow not-heated-air to be drawn into the drum, in the step of cooling the laundry, such that the laundry with the drum is cooled.

The amount of dry air ventilated into the drum may be adjustable based on the amount of laundry inside the drum.

The amount of dry air ventilated into the drum may be adjustable based on the operation time of the ventilation system.

It is to be understood that both the foregoing general description and the following detailed description are exemplary and explanatory and should not be construed as limiting the scope of the claims.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

In reference to FIG. 2, an embodiment of a dryer according to the present invention will be described.

Generally, dryers are home appliances that are used for drying the laundry during a process of cleaning the laundry. Dryers are categorized based on the method used to perform drying. For example, an exhaustion-type dryer and a condensation-type dryer are two different types of dryers that include different drying methods. In an exhaustion-type dryer, the laundry is dried by using external air that has been heated and then the air is exhausted out of the drum. In a condensation-type dryer, the air, which was used to dry the laundry is re-circulated or reused. The air is condensed such that moisture is removed from the air and then this air is heated and/or dried to be used to dry the laundry again.

Figure 1:
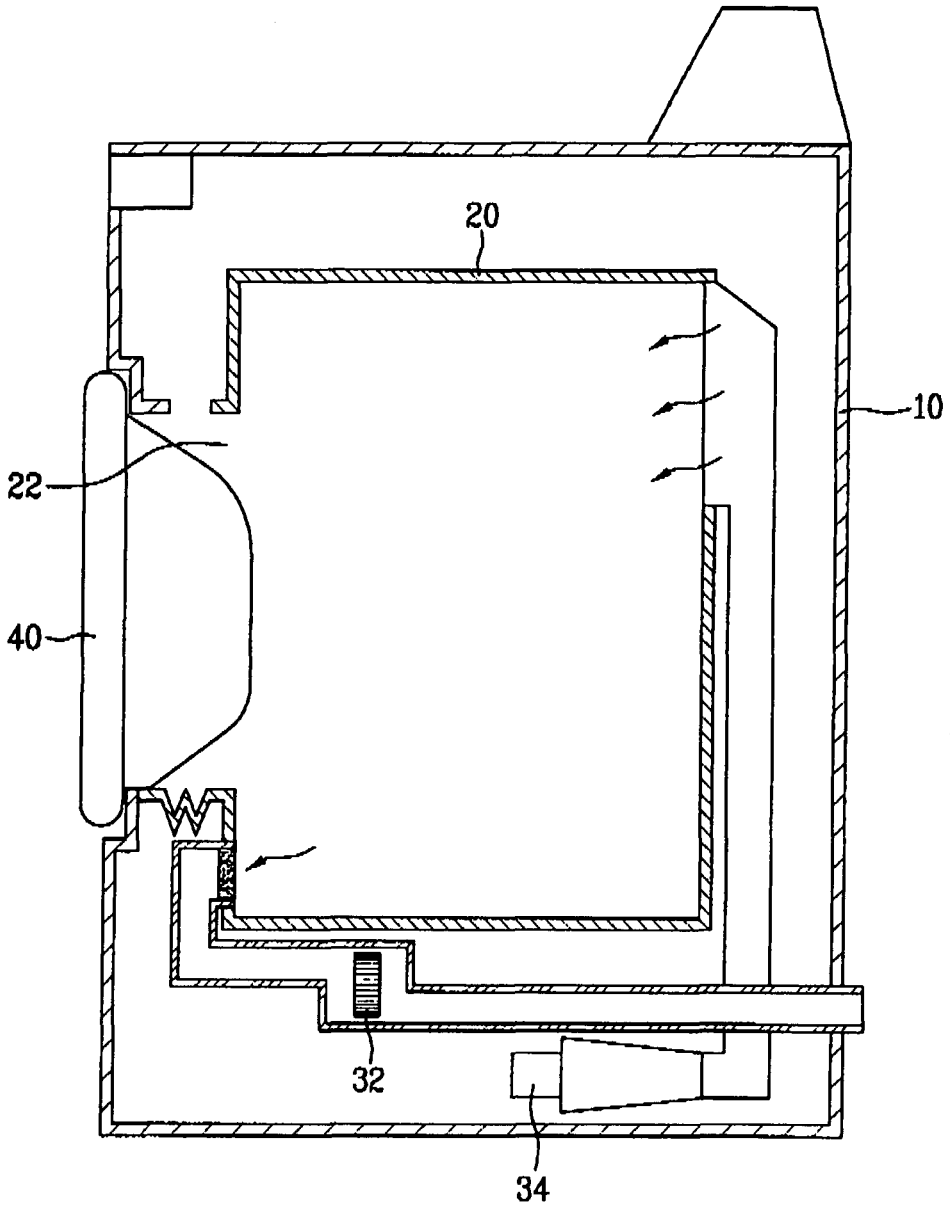
FIG. 1 Related Art
FIG. 1 is a sectional view schematically illustrating a conventional dryer.
Figure 2:
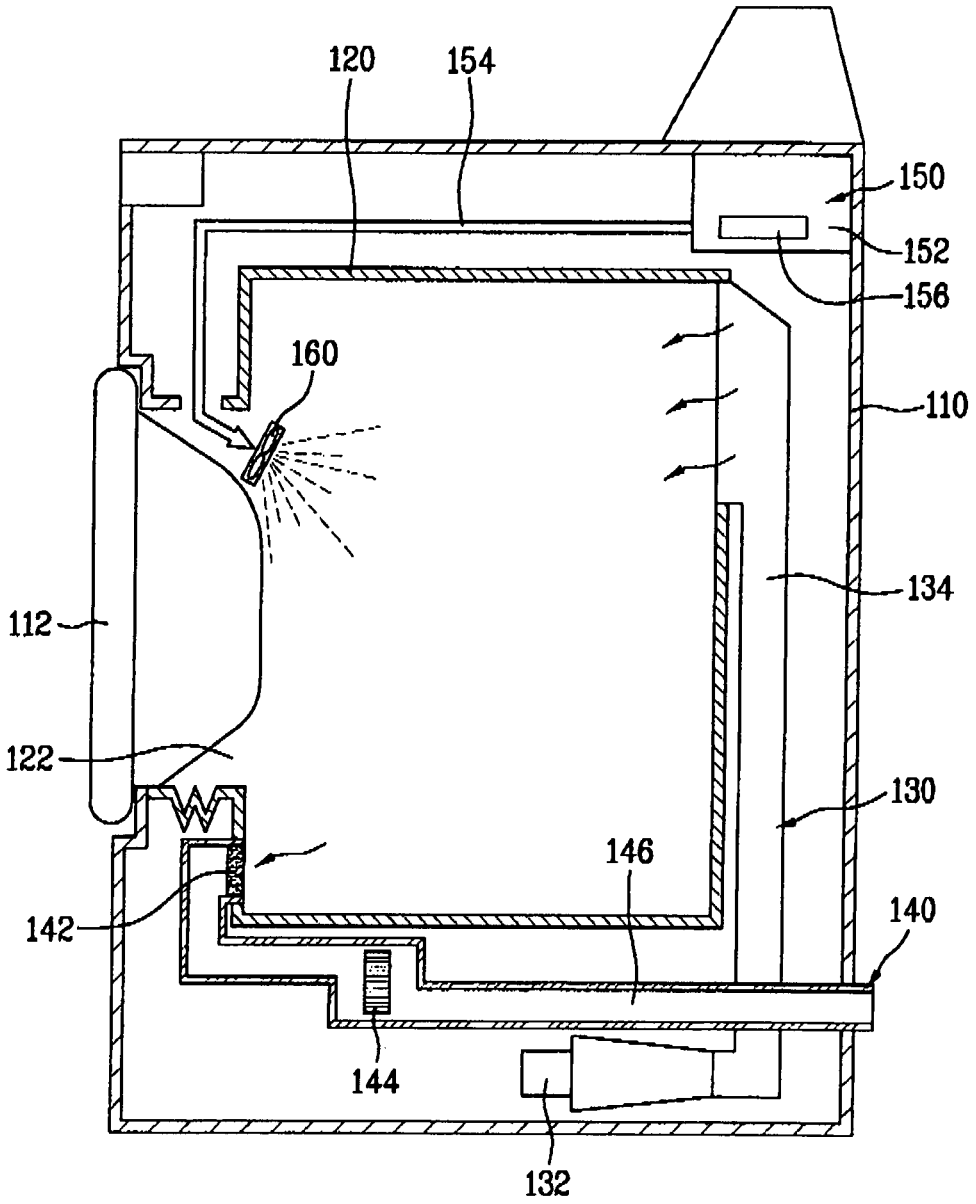
FIG. 2 is a sectional view illustrating an embodiment of a dryer according to the present invention.

In the embodiment illustrated in FIG. 2, the dryer is an exhaustion-type dryer.

The dryer includes a drum 120 and a ventilation system, which will be described below. The drum 120 is rotatable within a cabinet 110, which defines a housing of the dryer and an exterior portion of the dryer. The drum 120 is configured to receive and hold laundry therein. The ventilation system allows air to flow within the drum 120.

According to this embodiment, the ventilation system may include an air supply part 130 that supplies air to the drum 120 and an air exhaustion part 140 that exhausts air inside the drum 120 to outside the drum.

The shape of the drum 120 is substantially cylindrical. An opening 122 is formed in a side of the drum 120, through which laundry may be introduced or removed. An opening is also formed in a side of the cabinet to correspond to the opening in the drum. Also, a door 112 is coupled to a side of the cabinet 10 to open and close the opening 122.

The air supply part 130 includes a heater 132 that heats air to generate heated and/or dry air and a drying duct 134 through which the air heated by the drying heater 132 is guided into the drum 120. In general, the drying heater 132 may be a burner configured to switch on/off and burn gas to generate heat in accordance with the "on" state of the switch. The drying duct 134 is connected to a rear portion of the drum 120, through which air is supplied into the drum 120 in a forward direction of the drum 120. For example, the air may come in from a rear portion of the drum and may flow toward a front portion of the drum.

The air exhaustion part 140 includes a blower 144, a filter 142 and an exhaustion duct 146. The blower 144 draws in air from inside the drum 120 and directs air to pass through the filter 142 to have its foreign substances filtered. The exhaustion duct 146 extends outside the bounds of the cabinet 110, through which the air is exhausted outside. The exhaustion duct extends substantially beyond a surface of the cabinet such that it may protrude.

In the aforementioned embodiment, it is preferred that the filter 142 is installed in a front portion of the drum 120.

The blower 144 is operated to exhaust the air from within the drum 120 and discharge the air outside the drum through the exhaustion duct 146. Thus, the blower 144 is functioned to exhaust the air from within the drum 120, as well as to draw air into the drum 120 through the drying duct 134. At this time, if the drying heater 132 is in operation, then heated air is drawn into the drum 120. If the drying heater 132 is not in operation, then non-heated-external air is drawn into the drum 120.

Also, a steam generator 150 is provided in a predetermined portion of the cabinet to generate steam. For example, the predetermined portion can be the upper portion of the cabinet under the control panel, as illustrated in FIG. 2. The steam generator 150 includes a water reservoir 152, a heater 156 and a steam supply tube 154. The water reservoir 152 holds water and the heater 156 heats the water to generate steam. The steam supply tube 154 is configured to extend from the water reservoir 152 to the drum 120 to guide the steam into the drum 120.

When the steam generator 150 is operated, water is supplied to the water reservoir 152 to a desired level. Hence, when the heater 156 heats the water, steam is generated and the steam is discharged into the drum 120 through the steam supply tube 154.

Also, a steam diffuser is provided to diffuse the steam within the drum 120 uniformly. The steam diffuser may be a fan 160 installed on a pipe in such a way that steam is discharged into the drum 120. Preferably, the steam diffuser is installed at an end of the steam supply tube 154.

Since the steam is disseminated and dispersed due to the fan 160 and it is injected in the drum 120, the steam may be diffused uniformly within the drum 120. Moreover, since the steam is able to be injected relatively farther by the fan 160 than without fan 160, the steam may be diffused within the drum 120 in a relatively short period of time, as well as uniformly.

If the fan 160 is not provided at the end of the steam supply tube 154, the steam flowing in the steam supply tube 154 is discharged into the drum only by the pressure of the steam. To form an appropriate pressure needed for steam injection, the system would need more steam than the amount of steam that is normally required for a given load. However, if the fan 160 is provided at the end of the steam supply tube 154, the fan 160 is structured and functioned to draw the steam from within the steam supply tube 154, as well. Thereby, the appropriate pressure does not have to be formed at the end of the steam supply tube 154.

The above embodiment has been presented with respect to a dryer, but it is not limited thereto. The embodiment may be applied to any laundry device having a drying function.

Figure 3:
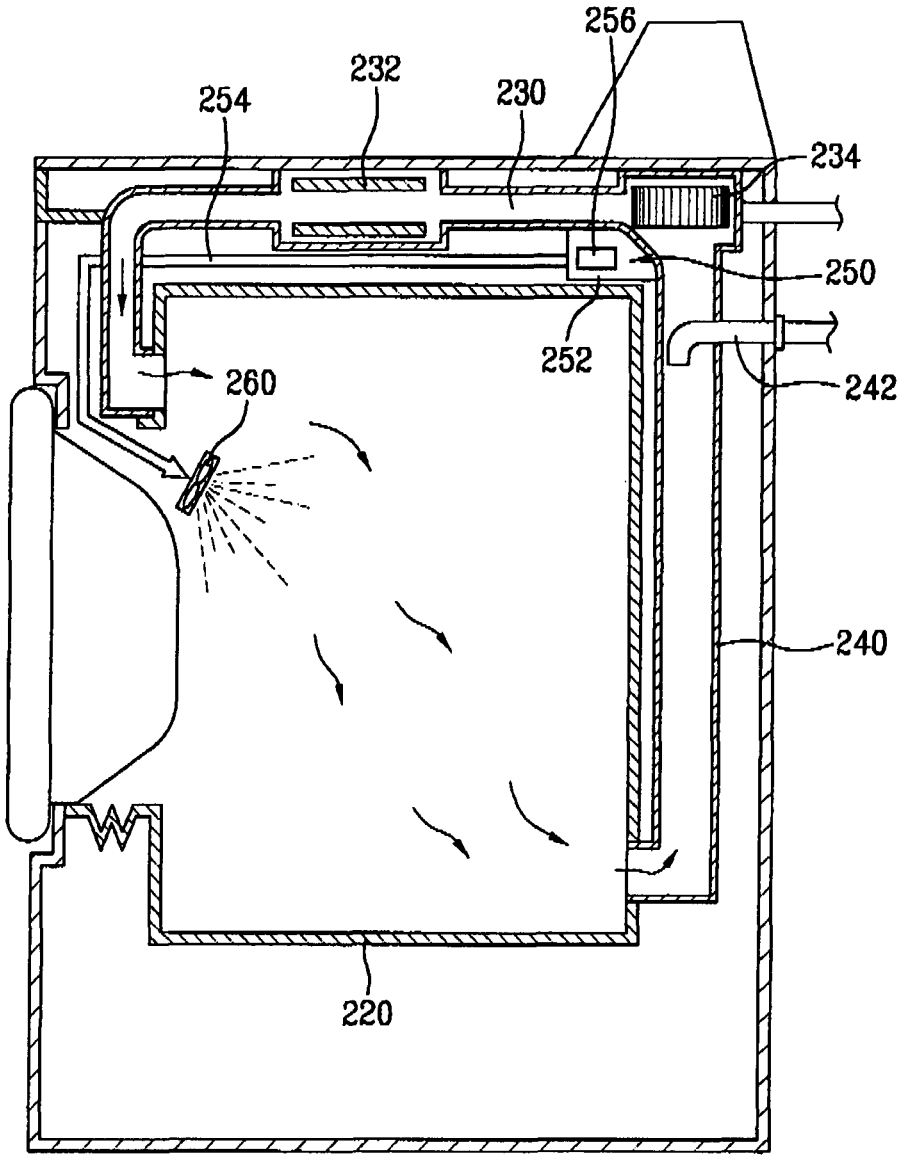
FIG. 3 is a sectional view illustrating another embodiment of the dryer according to the present invention.

FIG. 3 illustrates a dryer according to another embodiment of the present invention.

According to this embodiment, the dryer is a condensation-type dryer.

Air is circulated within a dyer to perform drying in a condensation-type dryer, unlike the exhaustion-type dryer described above.

A significant difference between a condensation-type dryer and an exhaustion-type dryer is the configuration of an air passage for circulating air into and out of a drum.

More specifically, the ventilation system of the exhaustion-type dryer includes the air supply part 130 for supplying air outside the drum into the drum and the air exhaustion part 140 for exhausting the air inside the drum 120 to outside the drum. Whereas, a ventilation system of the condensation-type dryer according to another embodiment includes a condensation duct 240 and a drying duct 230. The condensation duct 240 draws damp air from a drum 220 to condense the moisture contained in the air. The drying duct 230 heats the air having its moisture condensed to generate dry air.

The condensation duct 240 is functioned to draw in the air inside the drum 220 and a water supply tube 242 is provided in the condensation duct 240, wherein the moisture contained in the water is condensed.

One end of the drying duct 230 is connected to the condensation duct 240 and the other end of the drying duct 230 is connected to the drum 220. Also, a drying heater 232 is provided in the drying duct 230 to heat the air with its moisture condensed in the condensation duct 240. It is preferred that the portion of the drying duct 230 connected to the drum 220 is arranged in front of the drum 220 such that the dry air heated by the heater 232 may be diffused uniformly within the drum 220.

The drying duct 230 and the condensation duct 240 are substantially connected to each other. A blower 234 for ventilating air is installed at a portion where the drying duct 230 and the condensation duct 240 are connected.

Similarly to the steam generator of the exhaustion-type dryer according to the above embodiment, a steam generator 250 is installed in the condensation-type dryer according to this embodiment.

Like the former embodiment, the steam generator 250 includes a water reservoir 252, a heater 256 and a steam supply tube 254. It is preferred that the steam supply tube 254 is installed in a front portion of the drum 220 to inject steam into the drum 220.

Since the air inflow direction is opposite to the steam discharge direction within the drum, the fan 160 is provided to diffuse the steam in the above embodiment. Whereas, since air and steam are discharged from the drying duct 230 and the steam supply tube 254 in the same direction, respectively, the steam may be injected only by the blower 234 and diffused within the drum 220 without the fan of the exhaustion-type dryer.

Of course, to make the steam more finely dispersed or make the steam supply tube 254 draw steam more efficiently, a fan 260 may be provided.

Next, a method in accordance with one embodiment of the present invention will be described in detail. Configurations of the dryer will refer to the embodiments described above and the detailed explanation thereof will be omitted. Also, the method will be described with respect to an exhaustion-type dryer. Alternatively, the condensation-type dryer may be applicable as well.

Figure 4:
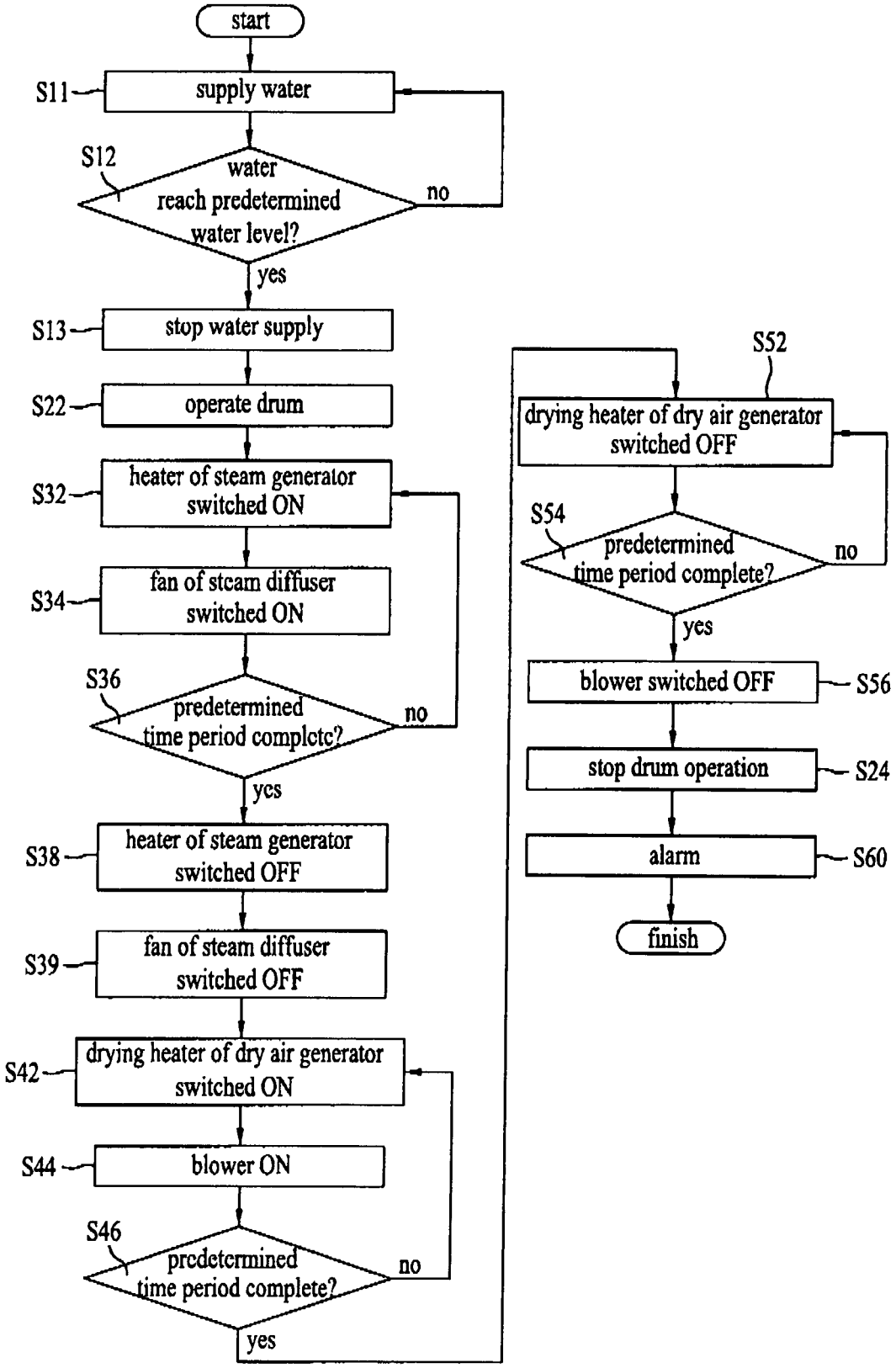
FIG. 4 is a flow chart illustrating an exemplary method for the dryer according to the present invention.

FIG. 4 is a flow chart illustrating a preferred embodiment of the method for a dryer according to the present invention.

The method for the dryer includes smoothing out wrinkles and removing static electricity on laundry within a drum; removing moisture of the laundry inside the drum; and cooling the laundry within the drum.

Furthermore, the step of smoothing out wrinkles and removing static electricity of laundry may include steps of operating a drum; exhausting steam into the drum; and diffusing the steam within the drum.

Next, the step of smoothing out wrinkles and removing static electricity of laundry will be described in detail.

Once a start command is inputted, water is supplied to the water reservoir 152 of the steam generator 150 (S11). If the water level of the water reservoir 152 reaches a predetermined level (S12), then the process of supplying water to the water reservoir 152 is stopped (S13). Hence, the drum 120 is operated and starts its rotation in a clockwise/counter-clockwise direction (S22), and the heater 156 is switched on to heat the water (S32). Then, the fan 160, provided at the end of the steam supply tube 154, is switched ON and starts to rotate (S34).

The water inside of the water reservoir 152 is boiled and steam is generated. The steam is guided to the drum through the steam supply tube 154 and the steam is exhausted within the drum 120. At this time, since the fan 160 is rotating, the steam collides against the fan 160 to be finely dispersed and the steam may be uniformly diffused within and throughout the drum 120.

Thus, the laundry is rotated by the rotary drum 120 and the steam is not heavily concentrated on some portions, but is uniformly supplied to the laundry inside the drum 120.

The drum 120 may be operated when the steam is discharged into the drum 120.

Preferably, the amount of steam supplied to the drum 120 is adjustable based on the amount of laundry. That is, a greater amount of laundry is introduced correlates to a greater amount of steam being discharged, and vice versa.

The amount of steam discharged into the drum may not be predetermined, because the value or level of the steam amount is variable based on the size of the drum 120 and the type of laundry fabric. However, it is easy for anyone skilled in the art to calculate or determine an appropriate level or amount of steam.

In case that the amount of steam discharged from the steam generator per unit hour is predetermined, the amount of steam is adjusted by adjusting the preset steam discharge time period. In case that the amount of steam discharged from the steam generator per unit hour is adjustable, the steam discharge time period may be preset.

As previously discussed, the water supply is stopped when the water level inside the water reservoir 152 reaches a predetermined level. However, the present method is not limited thereto. Water may be supplied to the water reservoir such that steam is generated, continuously.

When the steam is injected on the laundry inside the drum 120, the humidity of the laundry will increase and static electricity of the laundry will be removed. Together with those effects, wrinkles on the laundry will be also smoothed out.

The amount of steam that is discharged may be adjusted based on the steam discharge time period. If the time reaches a predetermined time period (S36), the heater of the steam generator is switched off to stop the steam generation (S38). Hence, the fan 160, provided in the steam supply tube 154, is also stopped (S39).

After the step of smoothing out wrinkles and removing static electricity of laundry is finished, the process of removing moisture from laundry inside the drum starts.

In the step of removing moisture from the laundry, a dry air generator including the drying heater 132 and the blower 144 is operated and dry air is ventilated into the drum 120 to dry the laundry (S42 and S44).

It is preferred that the operation time of the dry air generator is adjusted based on the amount of laundry inside the drum.

After the dry air generator is in operation during the predetermined time period (S46), the drying heater 132 of the dry air generator is switched off (S52).

Hence, the step of cooling the laundry starts.

In the step of cooling the laundry, the drying heater 132 is off and the blower 144 is operated to supply cool air into the drum 120 (S52).

Thus, the laundry heated by the hot dry air is cooled by the cool air. It is also preferred that the time when the blower 144 supplies cool air to the drum 120 is adjusted based on the amount of laundry. After the blower 144 supplies cool air to the drum during the predetermined time period (S54), the blower 144 is stopped and cool air supply is stopped (S56). Hence, the rotation of the drum 120 is stopped and the dryer is stopped (S24).

When all of the steps are completed, a step of alarming a user may be performed. The alarm may indicate or notify a user that the drying process is finished (S60). The step of alarming a user (S60) may include some sort of an alarm or an indicator, such as an LED, turning on/off, may be used.

Each step described above may be performed alone or may be included in a washing or drying process.

That is, when he/she wants to remove only static electricity, a user selects a cycle corresponding to removing only static electricity. The step of removing static electricity may be included in a refreshing cycle.

Here, the refreshing cycle may include performing an anti-wrinkling process to smooth out any wrinkles in the laundry and/or removing odor(s) in the laundry, provided that the laundry is not soiled such that it hinders the cleaning process.

Therefore, the dryer and the method for the same according to embodiments of the present invention may have following advantageous effects.

When steam is supplied, the fan disperses the steam. Thus, an appropriate pressure for uniformly dispersing the steam is not needed because the fan is able to diffuse the steam within the drum relatively quickly. Moreover, the amount of steam required for dispersion may be optimized, thereby requiring less energy consumption.

Furthermore, if the steam diffuser is not provided, steam will not diffuse uniformly, but will be concentrated on certain areas of the laundry. However, embodiments of the present invention provide a steam diffuser and thus steam is supplied uniformly within the drum. Hence, the steam is applied to every piece of laundry to enhance the effect of removing static electricity and smoothing out wrinkles.

In addition, since steam is supplied to the laundry uniformly, the amount of steam that needs to be generated may be reduced. Accordingly, the time for drying laundry may be shortened. Thus, embodiments of the present invention are advantageous in that static electricity, which might be generated again in a drying process, can be reduced or removed.

Still further, since static electricity of laundry is removed, the aforementioned system and method prevent the user from feeling unpleasant when wearing a piece of dried laundry with static electricity or wrinkles. Also, since the step of cooling laundry is provided, a user may neither feel too hot nor too damp when he/she wears a piece of dried laundry. Thereby, a user's level of satisfaction may be enhanced.

It will be apparent to those skilled in the art that various modifications and variations can be made without departing from the spirit or scope of the invention. Thus, it is intended that the claims cover the modifications and variations provided that they come within the scope of the claims and their equivalents.

What is claimed is:

1. A controlling method for a dryer having a drum for receiving laundry, a ventilation system including a drying duct, a drying heater and a blower to ventilate air within the drum, a steam generator separate from the ventilation system to generate steam using a water heater, a steam supply tube separate from the ventilation system to guide the steam to the drum, and a fan to uniformly diffuse the steam, the method comprising:

removing static electricity from laundry within the drum and smoothing out wrinkles on the laundry by supplying steam to the drum in a rearward direction of the drum separately from the drying duct, wherein removing the static electricity comprises:

rotating the drum;

determining a water level in a water reservoir of the steam generator;

turning on the water heater to heat water in the water reservoir, if the water level is at a predetermined level, and generating the steam;

guiding the steam to the drum;

rotating the fan located at an end of a supply steam tube at a top and inside of the drum, drawing the steam from the steam supply tube, and uniformly diffusing the steam throughout the drum;

adjusting an amount of steam guided to the drum using a calculation based on an amount of the laundry inside the drum;

turning off the water heater and stopping rotating the fan after the amount of steam is guided to the drum;

removing moisture from the laundry within the drum after the removing the static electricity, while the drying heater and the blower are operated supplying dry air into the drum in a forward direction of the drum; and cooling the laundry after the removing the moisture, while the blower is operated and the drying heater is not operated and supplying non-heated-air into the drum.

2. The controlling method for a dryer of claim 1, wherein the amount of the steam is adjustable based on a predetermined steam discharge time.

3. The controlling method for a dryer of claim 1, wherein an amount of dry air supplied into the drum is adjustable based on an amount of the laundry inside the drum.

4. The controlling method for a dryer of claim 1, wherein an amount of dry air supplied into the drum is adjustable based on a predetermined time.

5. The controlling method for a dryer of claim 1, wherein the water heater is turned on for a first predetermined time while guiding the steam.

6. The controlling method for a dryer of claim 1, wherein the drying heater and the blower are operated for a second predetermined during the removing the moisture.

7. The controlling method for a dryer of claim 6, wherein the blower is operated continuously for a third predetermined time after switching off the drying heater.

8. The controlling method for a dryer of claim 1, further comprising alarming a user to notify that an operation of the dryer is finished.

9. A controlling method for a dryer comprising:

removing static electricity from laundry within a drum and smoothing out wrinkles on the laundry, the removing static electricity comprising:

generating steam by turning on a water heater of a steam generator;

exhausting the steam from a steam supply tube into the drum in a rearward direction of the drum;

drawing the steam from within the steam supply tube and uniformly diffusing the steam within the drum by turning on a fan at an end of the steam supply tube at a top and inside of the drum;

adjusting an amount of steam within the drum using a calculation based on an amount of the laundry inside the drum;

turning off the water heater and the fan after the amount of steam is within the drum;

removing moisture from the laundry within the drum after removing the static electricity, while a drying heater and a blower of a ventilation system are operated and supplying dry air from a drying duct which is separate from the steam tube into the drum in a forward direction of the drum, wherein the steam generator is separate from the ventilation system and the steam tube separate from the ventilation system; and cooling the laundry, while the drying heater is not operated and the blower is operated, and supplying non-heated-air into the drum.

10. The controlling method for a dryer of claim 9, further comprising alarming a user to notify that an operation of the dryer is finished.

* * * * *